United States Patent [19]

Bevan et al.

[11] Patent Number: 4,996,184

[45] Date of Patent: Feb. 26, 1991

[54] SHEET MATERIAL FOR USE IN A METHOD FOR NON-IMPACT PRINTING, PHOTOCOPYING AND LIKE REPROGRAPHIC PROCESSES

[75] Inventors: Leonard N. Bevan, Warwickshire; Colin R. Moore, Worcestershire; Victor G. Atkinson, Birmingham, all of United Kingdom

[73] Assignee: Carrs Paper Limited, Solihull, United Kingdom

[21] Appl. No.: 330,692

[22] Filed: Mar. 30, 1989

[30] Foreign Application Priority Data

Mar. 30, 1988 [GB] United Kingdom ..... 8807598

[51] Int. Cl.[5] ..... B41M 5/22

[52] U.S. Cl. ..... 503/226; 503/206

[58] Field of Search ..... 427/150–152; 503/201, 206, 226

[56] References Cited

U.S. PATENT DOCUMENTS 4,036,511 7/1977 Maalouf ..... 503/226

FOREIGN PATENT DOCUMENTS 1145833 3/1969 United Kingdom ..... 303/201

OTHER PUBLICATIONS

Research Disclosure Document 25345, May 1985.

*Primary Examiner*—Bruce H. Hess

*Attorney, Agent, or Firm*—Spensley Horn Jubas & Lubitz

[57] ABSTRACT

Sheets of material, such as paper, having one one face a coating A of image-forming material (such as the CB coating of a carbonless copy system) are formed into pairs (51,52) connected together along one edge (53), by folding or by means of adhesive, with the coated faces (51*a*, 52*a*) in face-to-face contact leaving the remaining faces (51*b*, 25*b*) exposed, and such double sheets (50) are formed into stacks for use in non-impact printing processes by a method in which the printing is performed successively on the two exposed faces of the pairs of sheets and the two sheets are then separated.

4 Claims, 2 Drawing Sheets

FIG 2
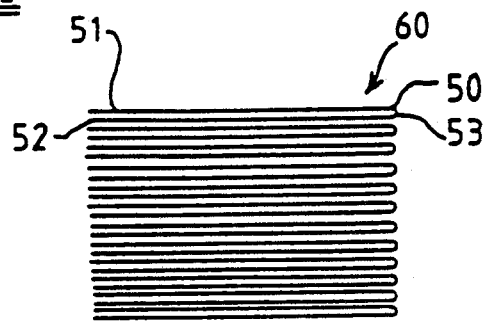
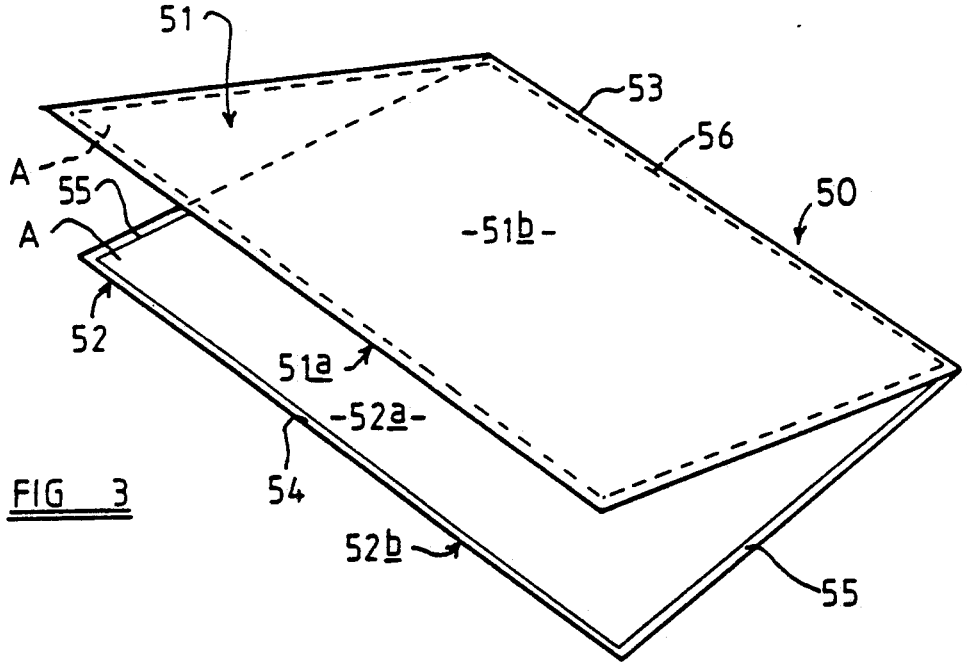
FIG 3
FIG 4
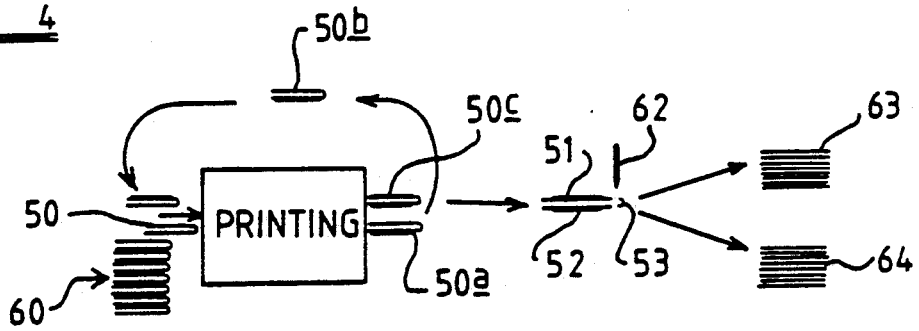

SHEET MATERIAL FOR USE IN METHOD FOR NON-IMPACT PRINTING, PHOTOCOPYING AND LIKE REPROGRAPHIC PROCESSES

BACKGROUND OF THE INVENTION

This invention relates to non-impact printing, photocopying and like reprographic processes and paper for use in such method.

The term "non-impact printing" is used herein to encompass various methods of forming an image on paper by means other than transferring an ink image mechanically from a carrier which strikes the paper forceably to imprint the ink on the paper. In particularly, but not exclusively, examples of non-impact printing processes include on the one hand thermal and electrostatic or electrosensitive imaging on appropriately sensitised papers, and on the other hand ink jet or toner deposition normally on plain paper, the most common toner based technology involving electrostatic transfer of toner to the paper followed by fusion of the deposited toner to form a permanent image. Similar techniques are employed in photocopying and other like reprographic processes, and the term "non-impact printing" is also intended to include such other processes.

In many cases, it is also required to print by these techniques onto paper having a sensitive layer (for example sensitive to pressure, heat, light, electric charge etc.) for other purposes. In particular there is currently a requirement, for example in the production of multipart sets, to print by various non-impact processes onto paper which carries a pressure sensitive layer in the form of an appropriate coating to enable the paper subsequently to be used for forming copies, without the use of carbon paper or the like, when used for conventional typing onto the pre-printed paper. These so-called "carbon-less" copy papers generally rely on two coatings formed respectively on the contiguous faces of superimposed sheets of paper, namely a coating containing a colour-forming substance, usually contained in microcapsules, on the back of the uppermost sheet (usually known as a CB coating) and a coating of a receptor layer on the front of the lowermost sheet (usually known as a CF coating). Colour-forming chemicals are typically dissolved in an oily solvent and encapsulated by well known techniques, and when such capsules are ruptured by mechanical pressure, as by impact of a type bar of a typewriter, the chemicals are released and react to form a visible mark on the CF coating of the adjacent sheet.

Conventially, paper for use in such copying systems is of three types, distinguished by their coatings, namely CB sheets having a CB coating on the underside to form the top sheet of the set, CF sheets having a CF coating on the upper side to form the bottom sheet of a set, and optionally CFB sheets having a CF coating on the upper side and a CB coating on the underside to form one or more intermediate sheets of a set where required. Such coatings are normally applied by a continuous process to cover the entire area of the appropriate face of the sheet.

In recent years, there has been a demand for printing onto such coated paper as the recipient material in tone-based printing systems in which an image is transferred to the recipient material electrostatically, a process sometimes known as "electronic or laser printing". However, difficulties have been experienced in such electrostatic printing systems when the recipient material comprises such coated papers. In particular, it appears that the handling of CB material, either before or during the printing process, may rupture some of the capsules containing the colour-forming chemicals, and this is particularly liable to lead to "poisoning" of the electrostatic transfer drum and also contamination of paper-feed rollers so that the printing apparatus fails to perform satisfactorily after a short period of operation using such CB (or CFB) sheets. No satisfactory solution to these problems has yet emerged.

Likewise other special paper coatings may interfere with the correct operation of various forms of non-impact printing apparatus or the printing process.

The present invention seeks to overcome such problems in a surprisingly simple and effective manner.

SUMMARY OF THE INVENTION

According to the invention we provide a method of printing by a non-impact method onto sheet material having one face thereof provided with a sensitive layer, the other face thereof being free of said sensitive layer wherein such sheet material is passed through non-impact printing apparatus by arranging sheets in pairs with said sensitive layers thereof in face-to-face relation so as to expose only said other faces whilst a non-impact printing operation is performed on the respective exposed face of each sheet in each such pair, and then separating the two sheets of each pair.

After printing onto one exposed face of one sheet of each such pair of sheets, the pair may be inverted if necessary and then passed again through the same, or another, non-impact printing apparatus to print onto the remaining exposed face of each pair of sheets before they are separated.

Thus, by placing in contact with one another those faces of two sheets which are coated with a material which may be deleterious to the apparatus or the printing process, the coating material is effectively enclosed between the two sheets and the risk of contamination of the apparatus or the printing process is greatly reduced.

In particular, it is envisaged that where the sheets comprises paper is for use in carbonless copying systems and has a CB coating, the CB coated faces of the two sheets will be in face-to-face contact.

In this way, the CB coatings will not during the printing operation come into direct contact with any parts of the printing apparatus and contamination of the apparatus, due for example to damage to the micro-capsule walls in the case of encapsulated coatings or direct abrasion in the case of non-encapsulated coatings is largely eliminated.

The other face of each sheet may carry a CF coating, the non-impact printing being carried out on the CF coating. In general most of the contamination arises from damage to the CB coating when such carbonless copying papers are printed. However, it will be appreciated that in any system where it is the CF coating which causes the problems, the CF coated faces may be arranged in face-to-face relation. Likewise, with other image-forming systems the faces with the coating, or the most damaging coating, will be arranged in face-to-face relation.

In accordance with a further feature of the present invention, the image-forming coating (particularly a CB coating) on each sheet does not extend completely to the edges of the sheets.

Even when the two sheets are arranged in face-to-face relation in a pair, if the coating extends fully to the edges of each sheet, there is a risk (albeit much reduced) of contamination arising from the exposed edges of the coating. In particular, some of the micro-capsules of a CB coating at the edges of the conventionally coated paper are liable to damage either when the paper is being fed through the printing apparatus or before it is fed in, particularly when being cut into sheets from a continuous web in which the coated paper is normally manufactured. By eliminating the CB coating from the edges of the paper, this source of contamination can also be eliminated.

Therefore, preferably, the peripheral margins of each sheet are free from said coating, but in some cases a significant reduction in contamination may be achieved by providing an uncoated margin along only one, two or three of the edges.

The sheets may be formed into pairs in which two sheets are connected together at at least one edge and thereby held in the required face-to-face relation. Preferably, the two sheets of each pair are formed integrally with one another and folded to form two leaves connected at said one edge and in said face-to-face relation for separation after completion of the printing process. To facilitate folding and separation, a row of perforations, such as micro-perforations, may be formed along the fold line.

Alternatively, two separate sheets may be secured together adhesively or otherwise along at least one edge. In either case the pari of sheets may be passed through the printing apparatus with the connected edge leading.

Separation of the two sheets after printing may be by tearing along any line of perforations provided, or simply by pulling apart a line of adhesive, but preferably the paper is cut. More particularly, the paper may be cut before the sheets are unfolded so as to remove a narrow marginal strip incorporating the connected edge.

Whilst the two sheets may bwe connected together along only one edge, as by folding or by means of adhesive, in some cases it may be desirable to secure them together for example adhesively at one or more further edges. Thus, they may be connected together at two opposed edges and in some cases at all four edges.

Where the two sheets of each pair are formed integrally and folded into the required face-to-face relation, the two sheets of paper in each pair will of course be identical, e.g. both CB or both CFB sheets or both CF sheets, and both of the same paper and of the same weight and size. Moreover, where the two sheets are initially separate and are connected to one another they will also usually be identical so that after completion of the printing process a single printed product is produced.

However, should it in any case be required to use two different kinds of sheet to form a pair, such as one CFB sheet and one CB sheet, this could be achieved by securing the two different sheets together into the required face-to-face relation for example by means of a line of adhesive material at one edge, preferably and edge where no CB coating is applied.

The invention further resides in a stack of sheets of material for use in the above method of printing, each sheet having one face thereof provided with a sensitive layer, the other face thereof being free of said layer wherein the sheets are arranged in pairs with said layers arranged in face-to-face relation, the two sheets of each pair being connected together at at least one edge and the neighbouring sheets of superposed pairs in the stack being unconnected with one another.

A further significant feature of the invention is that because the sheets are passed through the printing apparatus in pairs, the weight, thickness or stiffness of each single sheet may be less than could otherwise be handled satisfactorily by the apparatus, thereby making it possible to print onto lighter weight or more flexible paper.

BRIEF DESCRIPTION OF THE DRAWINGS

The invention will now be described by way of example with reference to one specific embodiment as illustrated in the accompanying drawings wherein:

FIG. 2 illustrates diagrammatically a stack of such coated paper prepared by the above method;

FIG. 3 illustrates one pair of sheets of paper, partially opened out for the purpose of illustration; and FIG. 4 is a diagram illustrating the printing method of the invention utilising the paper of FIG. 3.

DETAILED DESCRIPTION OF A PREFERRED EMBODIMENT

Figure 1:
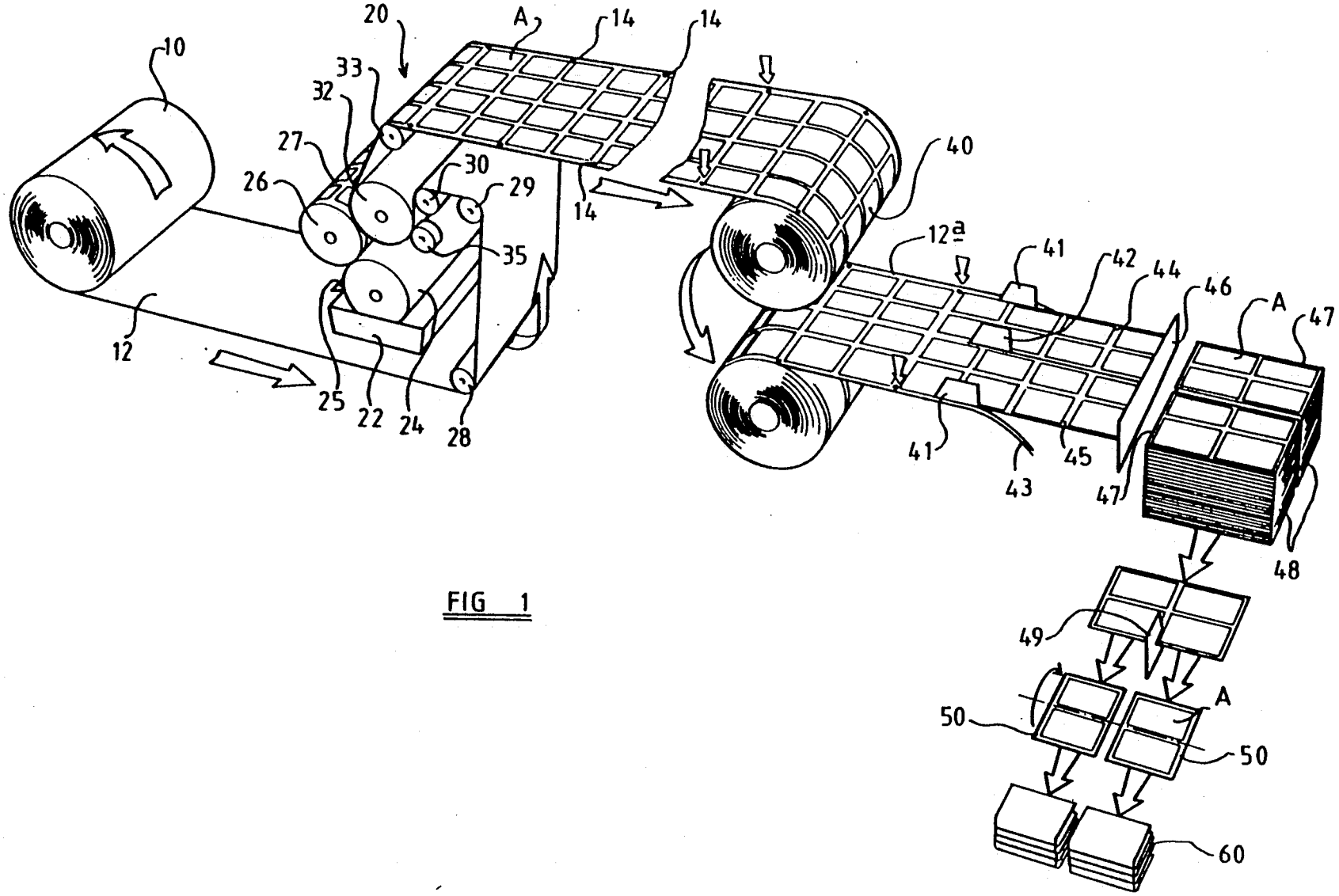
FIG. 1 illustrates diagrammatically a preferred method of making a stack of paper in accordance with the invention.

In the following example, the paper is for use in a carbonless copying system requiring CF and CB coatings for the formation of an image. The coatings used for this purpose are entirely conventional aqueous based systems and need not be described although the invention may also be applied to solvent based coatings. To prepare the coated sheets of paper, a web 12 of paper is unwound from a supply roll 10 and passed through a coating station 20 in which index marks 14 are printed at intervals along the margins of the web and in which the CB coating material is deposited onto one face of the web. Instead of being deposited uniformly over the entire width and length of the web as it passes through the coating station, it is preferably applied by a patch printing technique in discrete areas A spaced across the width of the web 12, (four-side-by-side patches being shown for the purposes of illustration) and spaced along the length of the web.

As illustrated, CB coating material is picked from a supply tank 22 by a gravure roller 24 provided with a doctor blade 25 and transferred to an offset roller 26 having receptor areas 27 corresponding to the areas A to be deposited on the web 12. The web 12 is fed around guide rollers 28, 29, 30 onto an impression roller 32 where it is brought into contact with the offset roller 26 in order to deposit the CB material in discrete patches. The coated paper leaves the coating station by passing over a guide roller 33 and coated web **12*a* is then dried and treated in conventional manner (not shown) to ensure dimensional stability and desired moisture content before being formed into a roll 40**.

The applied patches A or CB material are preferably dimensioned so as to correspond closely with a standard international paper size, such as A4, with the minimum practicable space in between adjacent patches. In this way, the size of the individual sheets can be kept to international standards and the coated area can extend to within not more than one or two millimeters from the edges of the sheet. Alternatively, the coated patches can correspond exactly to the international standard paper sizes, with the individual sheets thus being formed slightly oversize in relation to such standards to that, if desired, they can subsequently be cut down to a standard size after completion of the printing operation as hereinafter described.

To ensure accurate sizing of the printed patches, print rollers 35 (only one shown) are arranged to print the index marks 14 at spaced intervals along the margins of the web 12, for example at spacing corresponding to the length of two patches. At the exit end of the coating apparatus, optical readers are provided to measure the spacing between successive index marks (or to measure the average spacing of a predetermined number of index marks) and by conventional electronic means, a control signal is generated and fed back to regulate the speed of the offset roller 26 in order to maintain the correct patch length despite variations in the stretch or shrinkage of the web as it is processed prior to rolling. Such variations are particularly significant when aqueous coatings are used.

Where the web is to be formed into CFB sheets, it will be appreciated that the CF coating may be applied by conventional means, before or after the CB patches. It is contemplated that the CF coating may be entirely conventional and may be applied continuously over the entire length and width of the web, but if desired it could be applied in patches in register with the patches A or CB material on the opposite face of the web.

The coated web 12*a* is then divided by unwinding the roll 40 and passing the web 12*a* over slitter blades 41, 42 which separate the margins 43 bearing the index marks 14 and divide the web into strips 44, 45 each carrying two patches A side-by-side. Before the index marks 14 are removed, they are detected by optical readers to co-ordinate the operation of a cutter blade 46 which severs the strips 44, 45 into pieces 47 each two patches long, which are formed into stacks 48. The stacks 48 are then transferred to a cutting and folding machine in which each piece 47 is first slit by a blade 49 into two sheets 50, each of which carries two patches A in side-by-side relation, and each such sheet is then folded to form two leaves with the two patches A into face-to-face relation with one another, and the folded sheets 50 are then formed into stacks 60.

The sheets 50 may be formed with a line of perforations along the fold line prior to the folding operation if required.

Thus, as shown more clearly in FIG. 2, the invention firstly provides a stack 60 of double sheets 50 each comprising two leaves 51 and 52 connected together at one edge 53 in the illustrated case by an integral fold optionally with a line of perforations on the fold line. The stack 60 may, of course, be boxed or packaged, and subsequently transported, handled and sold in precisely the smae manner as conventional supplies of single sheets of paper.

The double sheets 50 carry the patches A of CB material on the inner, contacting faces 51*a*, 52*a* and any CF coating is on the exposed faces 51*b*, 52*b*, as seen most clearly from FIG. 3. The inner faces 51*a*, 52*a* have uncoated margins 54, 55 along their outer edges and there is an uncoated strip 56 at the folded edge 53. Perforations on the folded edge 53 not only facilitate folding and subsequent separation of the leaves 51 and 52 by tearing, but also allow air to escape from between the leaves as they are folded together so as to reduce the tendency for a budge to form at the folded edge. Thus, the line of perforations is desirably provided even where, as is preferred, the two leaves are subsequently to be separated by cutting away the folded edge portion.

Whilst it is particularly convenient to utilise two leaves 51, 52 integrally connected as a folded double sheet 50 as above described, it is alternatively possible to employ two separate single sheets formed for example by further slitting of the flat sheets 50 and to secure such single sheets together in the same face-to-face relation with the patches A in contact by applying a line of adhesive along one edge.

In both cases, adhesive may additionally be applied along the uncoated margin 54 opposite the edge 53 to increase the stiffness of the double sheet, and if appropriate along one or both of the end margins 55.

Such stacks 60 of double sheets 50 comprising leaves 51, 52 connected together at least along one set of edges 53 may then be printed on the exposed faces 51*b*, 52*b* by the method as illustrated in FIG. 4. It will be appreciated that in the stack 60, successive double sheets 50 are not in any way connected to one another so that each pair of leaves can freely be removed from the stack in the same manner as a single sheet of paper in a conventional stack.

Whilst it is preferred for the two leaves of each double sheet to be connected together at one or both of their longer edges, it will be appreciated that in some cases the leaves may be connected together at one or both of their shorter edges only.

In use, each successive double sheet 50 is taken from the stack 60 and passed through the non-impact printing apparatus, the two leaves remaining in face-to-face relation, with the connected edge 53 preferably leading. The required printing operation is performed on one exposed face of the double sheet. Subsequently, the double sheet after one pass (50*a*) may be inverted (50*b*) by any suitable mechanism and passed through the apparatus for a second time for completion of the printing operation on the other exposed face of the double sheet. This may be achieved either by re-forming the double sheets into a stack after their first pass through the apparatus and then returning the new stack, in inverted condition, to the input of the apparatus, or by inverting and returning each double sheet separately as it emerges from the first pass.

Alternatively of course the sheets may be fed through a printing machine operative to print on both said exposed faces simultaneously.

After completion of the printing (50*c*) the two leaves of each double sheet are separated, preferably by cutting off the connected edge portion 53 by means of a cutter blade 62, after which the separate leaves are formed into respective stacks 63, 64. Other uncoated margins, especially if connected by adhesive, may be trimmed away at the same time. Where the double of sheets have been passed twice through the same printing apparatus and therefore bear the same printed material, one of the two stacks can then be inverted, so that the printed faces of both stacks face the same way, and the two stacks placed together. On the other hand, instead of passing the double sheets a second time through the same apparatus, they could alternatively be fed to a second printing apparatus to complete the printing operation. This would be particularly useful for printing on CBF sheets for forming into multi-part sets which include at least two CFB sheets on which the required printing differs, so that when the two leaves of each double sheet are subsequently separated, they can be formed into two stacks according to the nature of the printing. Thus, where the pairs have been passed successively through different printing apparatus and the two leaves of each double sheet carry different printed information, the two stacks 63, 64 can be kept separate.

Whilst in the above description, reference throughout is to integrally connected leaves 51,52 formed by folding a double sheet 50, it will be appreciated, as previously mentioned that two separate sheets may be adhesively secured together along one or more edges.

Also whilst it is preferred that the CB coating is applied in the form of discrete patches A, it will be appreciated that the CB coating could be applied in conventional manner across the entire area of the sheet.

CB and CFB sheets may be printed in this way and then assembled together with CF sheets into multi-part sets, the CF sheets being printed individually in conventional manner or in pairs in the manner as described above.

In the same manner, information may be printed by non-impact methods on other types of coated paper.

It will therefore be appreciated that in general terms the invention provides a method of printing onto paper or other material which carries on one face thereof a coating which would normally be regarded as incompatible with the printing process, the printing being carried out on the opposite face of the material whilst it is arranged in pairs of sheets with the coated faces together.

This technique is particularly applicable to printing onto carbonless copy paper of the type employing CB coatings since printing is normally required only on the CF or uncoated side, and it is the CB coating which is particularly liable to cause contamination of electrostatic printing processes. By arranging the CB coatings in face-to-face relation, any damage to the micro-capsules containing the colour-forming chemicals, during passage of the paper through the printing apparatus will be confined between the two sheets of paper so that contamination of the working parts of the apparatus can largely be eliminated. Additionally, by confining the CB coating to a specific area away from the marginal portions of each sheet, the risk of contamination by traces of the coating becoming detached from the edges of the sheets is also effectively eliminated.

However, the invention has been described specifically in relation to the production and use of CB sheets for use in carbonless copy systems, it will be appreciated that it may be applied with equal advantage to other types of coating which are liable to give rise to problems if used in a non-impact printing apparatus.

We claim:

1. A stack of sheets of material wherein each sheet has one face thereof provided with a CB coating for a carbonless copy system and another face thereof free of said CB coating, and the sheets are arranged in pairs with said CB coatings thereof arranged in face-to-face relation, the two sheets of each pair being connected together at least at one edge thereof and the neighboring sheets of superposed pairs in the stack being unconnected with one another.

2. A stack of sheets according to claim 1 wherein the two sheets of each pair are formed integrally with one another and folded into said face-to-face relation.

3. A stack of sheets according to claim 1 wherein the two sheets of each pair are separate sheets secured together along at least one edge thereof.

4. A stack of sheets according to claim 1 wherein the two sheets of each pair are connected together additionally along one or more further edges thereof.

* * * * *